US010612286B2

(12) United States Patent
Lammes et al.

(10) Patent No.: US 10,612,286 B2
(45) Date of Patent: Apr. 7, 2020

(54) REVOLVING DOOR

(71) Applicant: Royal Boon Edam International B.V., Edam (NL)

(72) Inventors: Hendrik Lammes, Edam (NL); Melvin Jarno van der Molen, Schagen (NL); Gertjan Otto, Purmerend (NL)

(73) Assignee: ROYAL BOON EDAM INTERNATIONAL B.V., Edam (NL)

( * ) Notice: Subject to any disclaimer, the term of this patent is extended or adjusted under 35 U.S.C. 154(b) by 0 days.

(21) Appl. No.: 16/171,891

(22) Filed: Oct. 26, 2018

(65) Prior Publication Data

US 2019/0063131 A1 Feb. 28, 2019

Related U.S. Application Data

(63) Continuation-in-part of application No. PCT/NL2017/050262, filed on Apr. 24, 2017.

(30) Foreign Application Priority Data

Apr. 26, 2016 (NL) ..... 2016678

(51) Int. Cl.
*E05D 15/02* (2006.01)
*E06B 3/90* (2006.01)

(52) U.S. Cl.
CPC ..... *E05D 15/02* (2013.01); *E06B 3/90* (2013.01)

(58) Field of Classification Search
CPC ..... E05D 15/02; E06B 3/90; E05Y 2900/132; E05F 15/608
USPC ..... 49/42, 44, 45
See application file for complete search history.

(56) References Cited

U.S. PATENT DOCUMENTS

| | | | | |
|---|---|---|---|---|
| 798,786 | A * | 9/1905 | Hansen | E06B 3/90 49/44 |
| 1,024,797 | A | 4/1912 | Malocsay | |
| 1,184,725 | A * | 5/1916 | Dawes | E05C 7/002 49/68 |
| 1,417,372 | A * | 5/1922 | Friedland | E06B 3/90 49/42 |
| 2,081,774 | A | 5/1937 | Shields | |
| 3,726,044 | A * | 4/1973 | Economou | E06B 3/02 49/42 |
| 4,341,165 | A | 7/1982 | Calandritti et al. | |
| 5,634,295 | A | 6/1997 | Bunzl | |
| 6,367,198 | B1 | 4/2002 | Rockenbach | |
| 6,370,822 | B1 * | 4/2002 | Otto | E05F 15/608 49/42 |

(Continued)

FOREIGN PATENT DOCUMENTS

| | | |
|---|---|---|
| DE | 9208898 | 4/1993 |
| DE | 4211861 | 10/1993 |

(Continued)

*Primary Examiner* — Jerry E Redman

(74) *Attorney, Agent, or Firm* — Peacock Law P.C.; Justin Muehlmeyer; Janeen Vilven

(57) ABSTRACT

A revolving door comprising a wall or walls in which openings for inlet and outlet of persons and/or objects are provided, and rotatable door wings that during use are rotatable around an imaginary central vertical axis in a passage area surrounded by the wall or walls, wherein each door wing is supported by a movable carrier dedicated to such door wing, which carrier comprises a horizontal bar and a vertical bar.

15 Claims, 7 Drawing Sheets

(56) References Cited

U.S. PATENT DOCUMENTS

| | | | | |
|---|---|---|---|---|
| 2009/0031632 | A1* | 2/2009 | Wang | E05F 15/608 49/44 |
| 2009/0293362 | A1* | 12/2009 | Wang | E05D 15/48 49/45 |
| 2010/0050525 | A1 | 3/2010 | Blasi | |
| 2018/0371828 | A1 | 12/2018 | Lammes et al. | |

FOREIGN PATENT DOCUMENTS

| | | | | |
|---|---|---|---|---|
| DE | 19905473 | | 1/2001 | |
| EP | 0296134 | | 12/1988 | |
| EP | 0606193 | | 7/1994 | |
| EP | 0715049 | | 6/1996 | |
| EP | 2236716 | A2 * | 10/2010 | E05D 15/58 |
| FR | 2373664 | | 7/1978 | |
| JP | 2007070437 | | 3/2002 | |
| JP | 2010001735 | | 1/2010 | |
| NL | 9302235 | | 7/1995 | |
| WO | WO-9725509 | A1 * | 7/1997 | E05D 15/02 |
| WO | 02/10543 | | 2/2002 | |
| WO | 2017/150974 | | 9/2017 | |
| WO | 2017/188810 | | 11/2017 | |
| WO | 2018/208148 | | 11/2018 | |

* cited by examiner

REVOLVING DOOR

CROSS-REFERENCE TO RELATED APPLICATIONS

This application is a continuation-in-part application of International Application No. PCT/NL2017/050262, filed on Apr. 24, 2017, which claim priority to Netherlands Patent Application No. 2016678, filed on Apr. 26, 2016, and the specification and claims thereof are incorporated herein by reference.

BACKGROUND OF THE INVENTION

The invention relates to a revolving door comprising a wall or walls in which openings for inlet and outlet of persons and/or objects are provided, and rotatable door wings that during use are rotatable around an imaginary central vertical axis in a passage area surrounded by the wall or walls, wherein a carrier or carriers are provided for the door wings.

Examples of such a revolving door with an imaginary central vertical axis and therefore without a fixed central column are known from for instance U.S. Pat. No. 5,634,295, from EP 0606193, and from EP 0715049.

BRIEF SUMMARY OF THE INVENTION

The dimensions of such known revolving doors without a central column are limited due to their impaired strength in view of the missing central column. Accordingly, the known revolving door is limited in its applicability, for instance due to its reduced capability to withstand wind load. Another problem is the inertia of the door which, particularly with larger diameters, may be too high to enable quick starting and stopping of the door. Still another problem is that the door wings of the revolving door without a central column tend to touch the floor due to bending forces in the construction, in view of the constructions' unsatisfactory rigidity.

It is therefore an object of the invention to provide a revolving door with increased rigidity or stiffness, and wherein the prior art problems are effectively reduced.

It is another object of the invention to provide a construction of the revolving door according to a modular design, to enable easy mounting and dismounting.

It is still another object of the invention to provide a revolving door which can be easily converted between configurations with different numbers of door wings while maintaining the outer dimensions of the revolving door.

According to the invention a revolving door is proposed as well as an assembly of a supporting construction and a door wing or door wing parts that are embodied with the features mentioned in one or more of the appended claims.

In a first aspect of the revolving door of the invention each door wing has a carrier dedicated to such door wing, which carrier comprises a horizontal bar and a vertical bar connected to said horizontal bar, wherein each door wing has two door wing parts that are positioned on opposite sides of the vertical bar of the carrier that supports the concerning door wing. Accordingly the invention is also embodied in an assembly of a supporting construction and a door wing or door wing parts, wherein the supporting construction is embodied as a carrier comprising a first or horizontal bar and a second or vertical bar at right angles connected to said first or horizontal bar, wherein each door wing has two door wing parts that are positioned on opposite sides of the second or vertical bar of the carrier. With this construction it is possible to provide sufficient stiffness or rigidity to the revolving door by means of the carrier construction, in spite of the revolving door missing a fixed central column. Moreover, the assembly of the supporting construction embodied as a carrier and a door wing or door wing parts supported thereby or suspended therefrom, can be easily handled and makes easy mounting and dismounting possible even in revolving doors of considerable sizes and dimensions. Another big advantage is that the required working height for mounting the revolving door of the invention in a façade of a building can be limited to the bare minimum, independent whether use is made of fixed door wings or slidable door wings.

Preferably the horizontal bar is arranged perpendicular to the door wing. This provides that loads such as the forces of the wind pushing at the door wing are effectively absorbed in the construction, since the load can be received by the vertical bar and then guided into the horizontal bar in its longitudinal direction. There is therefore hardly any load bearing against the horizontal bar that would provide it with a twisting moment.

In a further preferred embodiment each door wing has two door wing parts that are positioned on opposite sides of the vertical bar of the carrier that supports the concerning door wing. This has the advantage that a wind load pushing at the two door wing parts on respective sides of the vertical bar exactly compensate each other so that no torsional moment acts on the vertical bar of the carrier.

Suitably the horizontal bar is provided with guide wheels that cooperate with a guide rail in a canopy of the door. The guide rail can have a smaller diameter than the revolving door, which is beneficial to make mounting and dismounting easy of the assembly of the carrier construction with the door wing or door wing parts.

Commonly the revolving door is provided with a drive or drives for the door wings, in which case it is beneficial that in a construction wherein the door has plural carriers and door wings, the carriers are electronically or mechanically linked. This secures synchronicity in rotation of the door wings, and in case of a mechanical link a single drive can then suffice.

A reliable construction is provided by arranging that a crossbar connects to the carrier and is arranged perpendicularly with reference to the horizontal bar of the carrier, wherein the door wing is suspended from the crossbar. The crossbar or crossbars can in certain embodiments also be used to provide a mechanical link between the plural carriers of the revolving door.

The arrangement of the door wing or door wing parts can include all known embodiments of conventional doors. It is for instance possible to apply fixed door wings by arranging that the door wing or door wing parts are fixed to the carrier. It is however also possible that the door wing or door wing parts are collapsible or foldable while remaining connected with or near to the vertical bar of the carrier. In a preferable arrangement the door wing or the door wing parts are slidable. In the latter case it is preferred that the door wing parts are independently slidable.

Suitably a guide is provided at or near to an end of the vertical bar distant from the horizontal bar for guiding the slidable door wing or door wing parts. This improves the rigidity or stiffness of the construction and is therefore a beneficial feature.

One particular advantageous feature of the revolving door of the invention is that while maintaining its dimensions the door is convertible between a door configured with two door wings in each other's extended direction, and a door configured with three door wings with angles of 120° between said door wings.

In the construction, wherein the revolving door has two door wings in each other's extended direction, it is beneficial for the sturdiness of the construction that the horizontal bars of the carriers of said door wings are parallel.

Likewise, in the construction wherein the revolving door has three door wings the horizontal bars of the carriers of said door wings substantially embody the legs of a triangle.

Further in the construction wherein the revolving door has four door wings, the horizontal bars of the carriers of said door wings form the branches of a rectangle.

As mentioned above the invention is also embodied in an assembly of a supporting construction and a door wing or door wing parts, comprising a carrier arranged to support or suspend the door wing or door wing parts from.

Preferably a horizontal bar of the carrier is at its extremities provided with guide wheels, and more preferably a vertical bar of the carrier is at a position distant from the horizontal bar provided with a guide for the door wing or door wing parts.

Suitably the assembly comprises a crossbar connected to the carrier, wherein the door wing or door wing parts are suspended from the crossbar which is arranged perpendicular to the carrier.

It is further preferred that the door wing has two door wing parts that are positioned on opposite sides of the vertical bar of the carrier.

Advantageously the door wing or door wing parts of the assembly are slidable. Alternatively or in addition the door wing or door wing parts of the assembly are collapsible or foldable while remaining connected with or near to the vertical bar of the carrier.

The invention will hereinafter be further elucidated with reference to the drawing of an exemplary embodiment of an apparatus according to the invention that is not limiting as to the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 3:
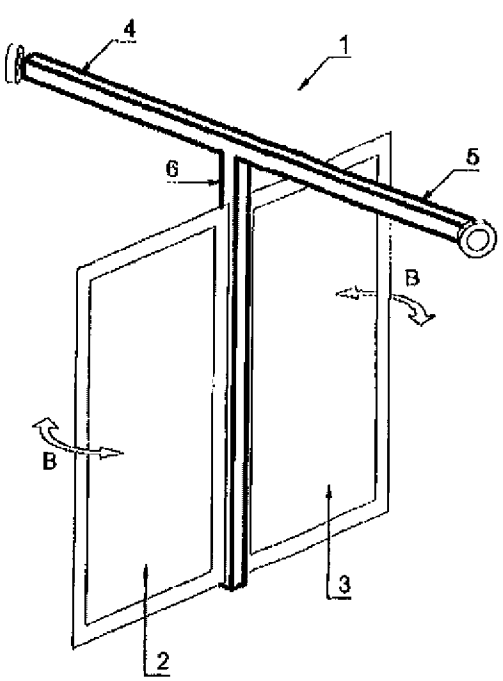
FIG. 3 shows a part of an assembly of a support construction and a collapsible door wing, comprising door wing parts, according to the invention.

Whenever in the figures the same reference numerals are applied, these numerals refer to the same parts.

Figure 2:
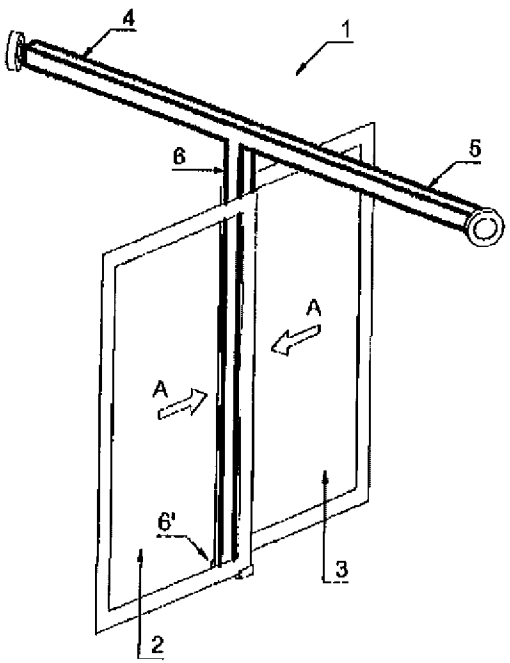
FIG. 2 shows a part of an assembly of a support construction and a slidable door wing, comprising door wing parts, according to the invention.
Figure 1:
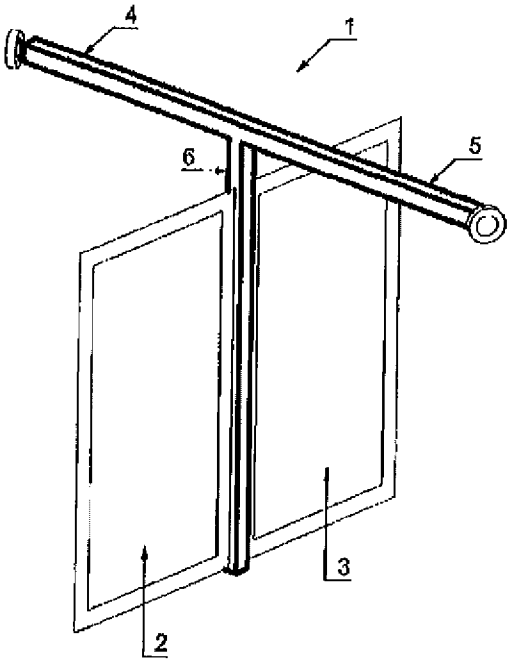
FIG. 1 shows a part of an assembly of a support construction and a fixed door wing according to the invention.

Reference is first made to FIGS. 1-3 showing different ways in which a door wing or door wing parts 2, 3 are arranged to cooperate with a support construction for the door wing or door wing parts. In all shown embodiments the door wing has two door wing parts 2, 3 that are positioned on opposite sides of a vertical bar 6 of the carrier 4. The door wing parts can however also be made unitary in a single door wing.

In FIG. 1 an assembly 1 according to the invention is schematically shown, comprising a supporting construction and a door wing or door wing parts 2, 3, wherein part of the supporting construction is a carrier 4 which is arranged to support or suspend the door wing or door wing parts 2, 3 from. The door wing parts 2, 3 are in this embodiment fixed to the vertical bar 6 that is suspended from a horizontal bar 5 of the carrier 4.

In FIG. 2 it is schematically shown that the door wing or door wing parts 2, 3 can be arranged slidable with reference to the carrier 4 as symbolized by arrows A. In this arrangement it is preferred—although not shown in the figure—that the vertical bar 6 of the carrier 4 is at a position 6' distant from the horizontal bar 5 provided with a guide for the door wing or door wing parts 2, 3.

In FIG. 3 it is schematically shown that the door wing or door wing parts 2, 3 are arranged to be collapsible or foldable as symbolized by arrows B, while remaining connected with or near to the vertical bar 6 of the carrier 4.

Figure 4:
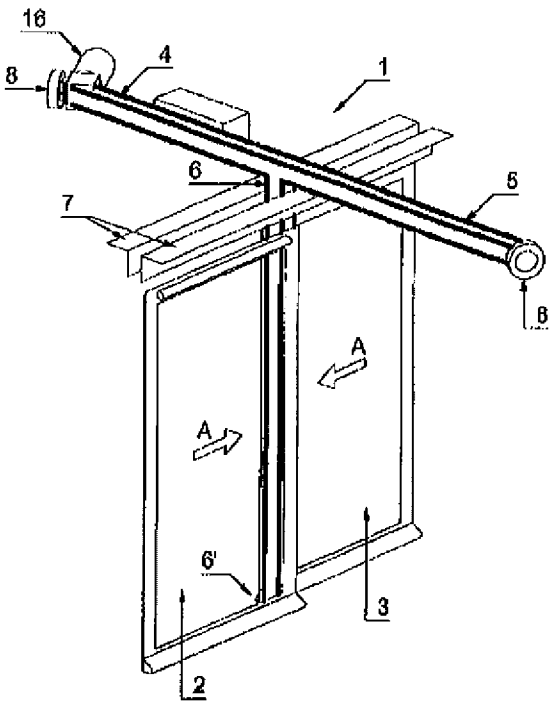
FIG. 4 shows a completed assembly of a support instruction and slidable door wing parts as shown in FIG. 2.

In FIG. 4 some more detail is shown of the construction according to FIG. 2, although the additionally shown features can also be applied in the embodiments of FIG. 1 and FIG. 3. FIG. 4 shows that a crossbar 7 is connected to the carrier 4, wherein the door wing or door wing parts 2, 3 are suspended from the crossbar 7 which is arranged perpendicular to the carrier 4. Further it is shown that the horizontal bar 5 of the carrier 4 is at its extremities provided with guide wheels 8.

Figure 5:
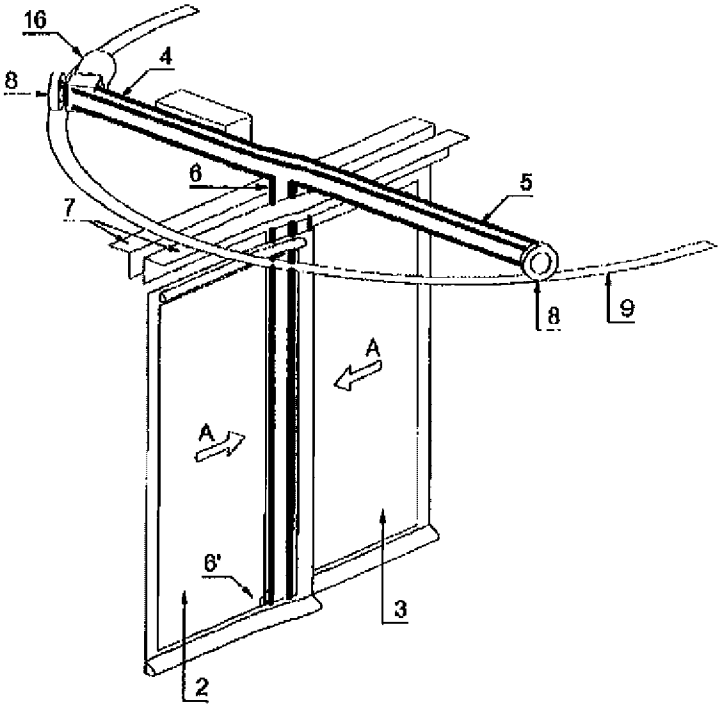
FIG. 5 shows the assembly of FIG. 4 suspended from a guide rail of a revolving door.

The just mentioned guide wheels 8 are arranged to cooperate with a guide rail 9 mounted in a canopy of a revolving door according to the invention, a detail of which revolving door is shown by FIG. 5. In FIG. 5 a drive by a motor 16 is also shown, which motor 16 causes in use that the assembly of the carrier 4 and the door wings 2, 3 rotates around an imaginary central vertical axis in a passage area surrounded by a wall or walls of the revolving door of the invention. The manner in which this functions will be immediately apparent to the skilled person from the following discussion of FIGS. 6-8 showing different embodiments of the revolving door of the invention in which the assembly discussed hereinabove with reference to FIGS. 1-5 is applied.

Figure 6:
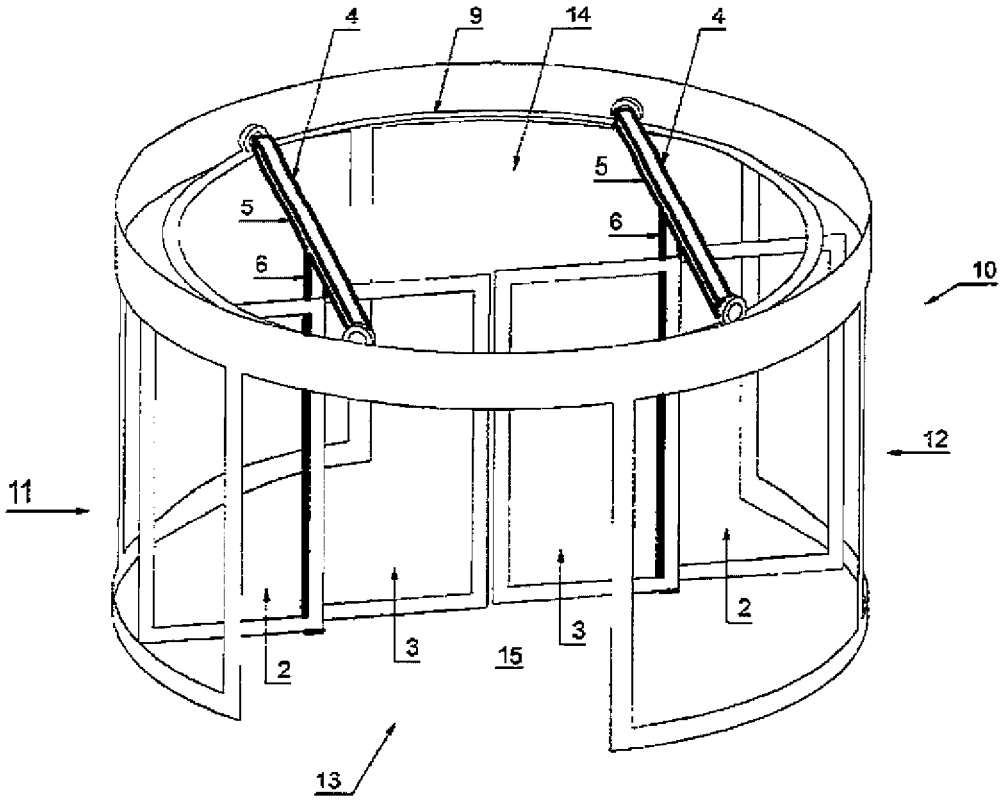
FIG. 6 shows a revolving door of the invention with two door wings.
Figure 7:
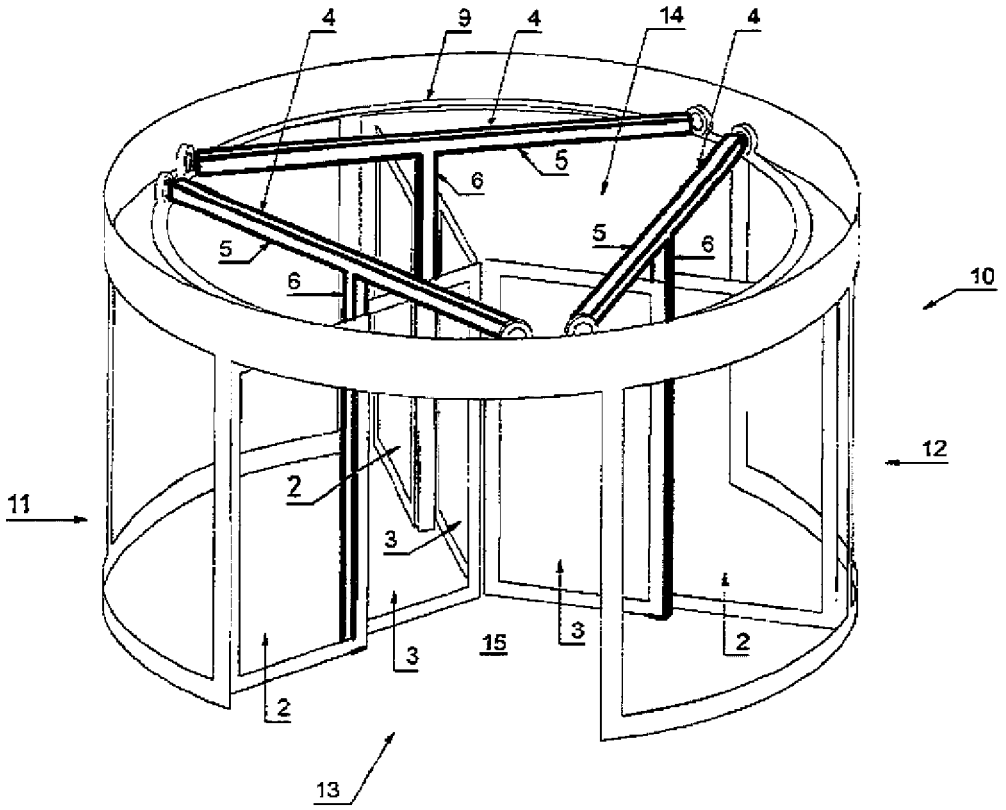
FIG. 7 shows a revolving door of the invention with three door wings.
Figure 8:
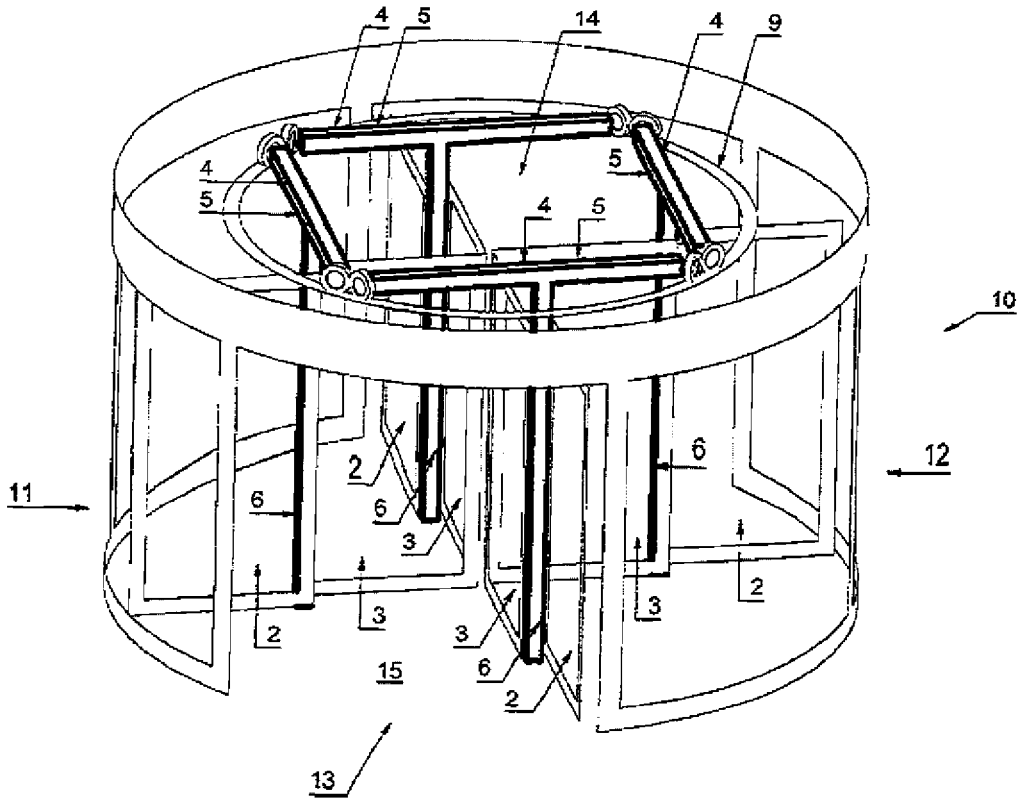
FIG. 8 shows a revolving door of the invention with four door wings.
Figure 9A:
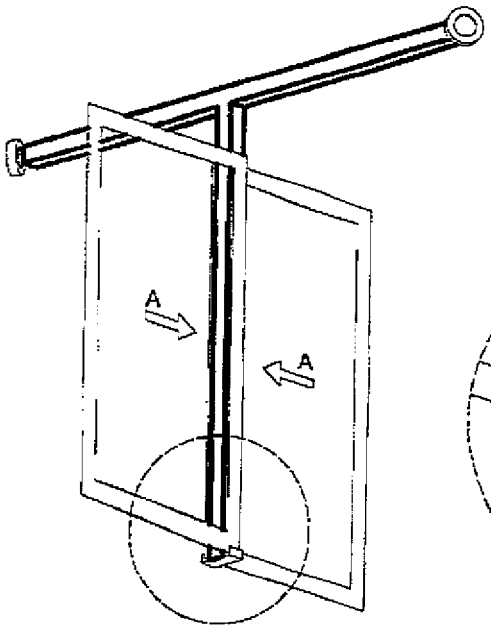
FIGS. 9*a* and 9*b* show in detail a guide for a sliding door of the revolving door of the invention.
Figure 9B:
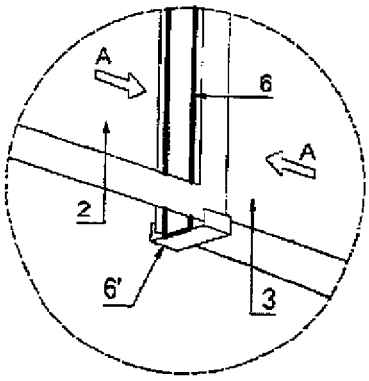

In all FIGS. 6-8, the revolving door 10 of the invention is shown, comprising a wall or walls 11, 12 in which openings 13, 14 for inlet and outlet of persons and/or objects are provided. In a passage area 15 surrounded by the wall or walls 11, 12, rotatable door wings 2, 3 are provided that during use rotate around an imaginary central vertical axis of the revolving door 10. Accordingly, to what has been discussed hereinabove with reference to FIGS. 1-5 each door wing or door wing part 2, 3 is supported by a movable carrier 4 dedicated to such door wing or door wing part 2, 3, which carrier 4 comprises a horizontal bar 5 and a vertical bar 6. As FIG. 6 clearly shows the horizontal bar 5 is each time perpendicular to the door wing or door wing part 2, 3. In the shown embodiment each door wing has two door wing parts 2, 3 that are positioned on opposite sides of the vertical bar 6 of the carrier 4 that supports the concerning door wing parts 2, 3. In FIGS. 9*a* and 9*b* a guide 6' can be positioned at or near the lower end of the vertical bar 6 is shown which is preferably used when the door wing parts 2, 3 are arranged to be slidable (as shown in FIG. 2).

To improve clarity of the FIGS. 6-8, particularly other features of the assembly as shown in FIG. 4 and FIG. 5 are not shown. This for instance applies to the crossbar 7 that connects to the carrier 4 and which is arranged perpendicularly with reference to the horizontal bar 5 of the carrier 4, and wherein the door wing or door wing parts 2, 3 are suspended from the crossbar 7.

The revolving door 10 of FIG. 6 shows a high-traffic solution with two sets of door wings 2, 3 that are arranged in each other's extended direction, wherein the horizontal bars 5 of the carriers 4 of said sets of door wings 2, 3 are parallel.

FIG. 7 shows an embodiment of the revolving door 10 wherein three sets of door wings 2, 3 are applied, wherein the horizontal bars 5 of the carriers of said sets of door wings 2, 3 substantially embody the legs of a triangle.

One attractive feature of the revolving door 10 of the invention is that it enables that the revolving door 10 is convertible while maintaining its dimensions between a configuration with two sets of door wings placed in each other's extended direction as shown in FIG. 6, and a door with three sets of door wings that are configured with angles of 120° between said sets of door wings as shown in FIG. 7.

FIG. 8 shows again another embodiment of the revolving door 10 of the invention, wherein it has four sets of door wings 2, 3, and wherein the horizontal bars 5 of the carriers 4 of said sets of door wings 2, 3 form the branches of a rectangle.

Finally it is reminded that the arrangement discussed above with reference to FIG. 5, the construction was shown to be provided with a motor 16 for driving the door wings 2, 3. In the just discussed embodiments of FIG. 6-8 wherein the door each time has plural carriers 4 and plural sets of door wings 2, 3, it is then preferred that the respective carriers 4 of the sets of door wings 2, 3 are electronically or mechanically linked to maintain a synchronic drive of the respective door wings 2, 3 of the revolving door 10.

Figure 11:
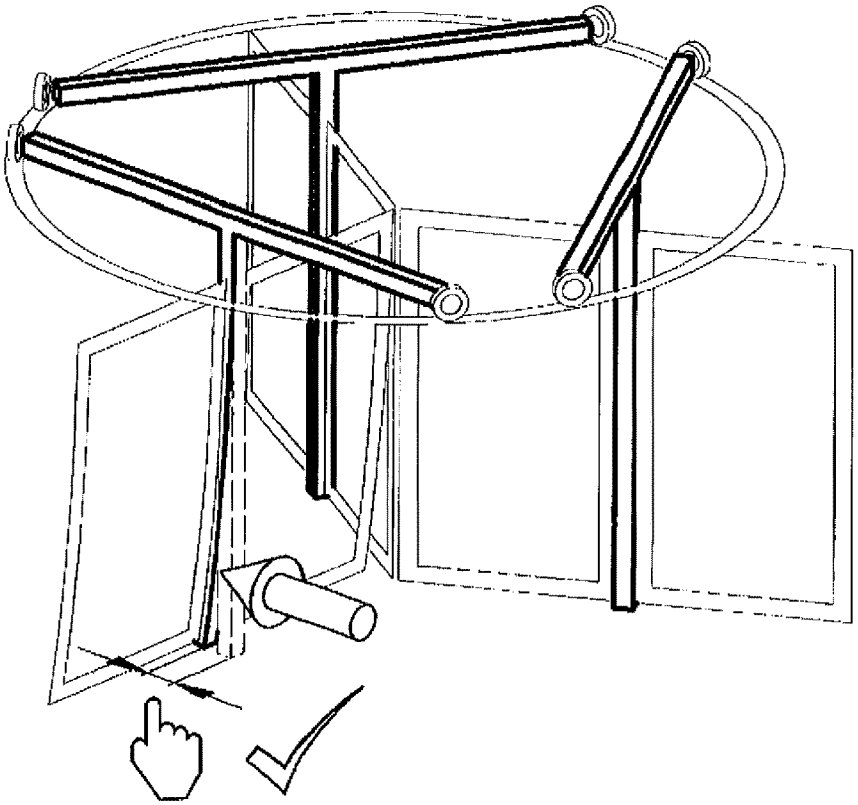
FIGS. 10 and 11 show comparatively next to each other a revolving door according to the prior art and a revolving door according to the invention.
Figure 10:
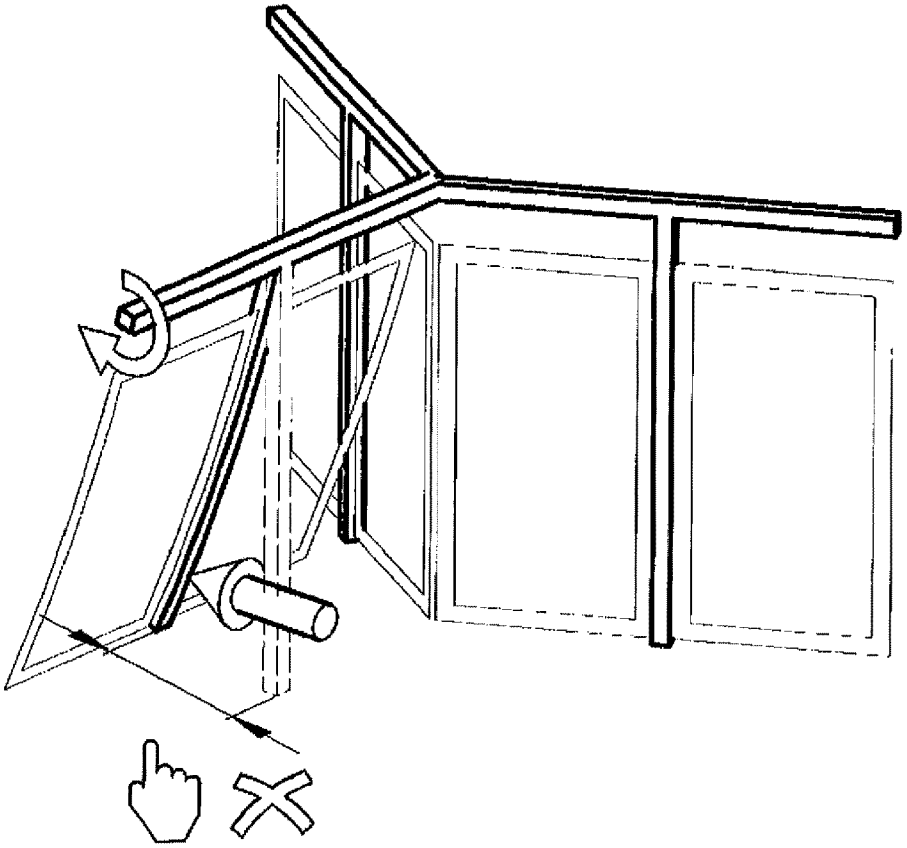

In the revolving door of the invention one out of plural favourable aspects is that loads such as the forces of the wind pushing at the door wing are effectively absorbed in the construction, since the load can be received by the vertical bar and then guided into the horizontal bar in its longitudinal direction. There is therefore hardly any load bearing against the horizontal bar that would provide it with a twisting moment. This is symbolized in the drawing of FIG. 11 which relates to the revolving door of the invention. Conversely and comparatively FIG. 10 depicts the absorbance of a similar load acting on the door wing of a revolving door according to the prior art. In this latter construction there is a similar twisting moment applied to the horizontal bar of the carrier, but this acts transversely to the horizontal bar which is consequently less easily absorbed in the construction.

Although the invention has been discussed in the foregoing with reference to several exemplary embodiments of the revolving door of the invention, the invention is not restricted thereto and can be varied in many ways without departing from the invention. The discussed exemplary embodiments shall therefore not be used to construe the appended claims strictly in accordance therewith. On the contrary the embodiments are merely intended to explain the wording of the appended claims without intent to limit the claims. The scope of protection of the invention shall therefore be construed in accordance with the appended claims only, wherein a possible ambiguity in the wording of the claims shall be resolved using these exemplary embodiments.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A revolving door comprising:

a wall or walls in which openings for inlet and outlet of persons or objects are provided, and rotatable door wings that during use are rotatable around a central vertical axis in a passage area surrounded by the wall or walls, wherein a carrier or carriers are provided for the rotatable door wings, and wherein each rotatable door wing comprises a carrier dedicated to the rotatable door wing, which carrier comprises a horizontal bar and a vertical bar connected to the horizontal bar, wherein each of the rotatable door wings has two door wing parts each having a frame that are positioned on opposite sides of the vertical bar of the carrier that support the rotatable door wings.

2. The revolving door according to claim 1, wherein the horizontal bar is perpendicular to each of the rotatable door wings.

3. The revolving door according to claim 2, wherein the horizontal bar is provided with one or more guide wheels that cooperate with a guide rail in a canopy of the rotatable door.

4. The revolving door according to claim 1, wherein the horizontal bar is provided with one or more guide wheels that cooperate with a guide rail in a canopy of the rotatable door.

5. The revolving door according to claim 1, wherein the revolving door is provided with a drive or drives for each of the rotatable door wings, and wherein the revolving door has a plurality of carriers and a plurality of rotatable door wings, wherein the plurality of carriers are electronically or mechanically linked.

6. The revolving door according to claim 1, wherein a crossbar connects to the carrier and is arranged perpendicularly with reference to the horizontal bar of the carrier, wherein the rotatable door wing or the two door wing parts are suspended from the crossbar.

7. The revolving door according to claim 6, wherein a guide is provided at a position at or near to an end of the vertical bar for guiding the rotatable door wing or the two door wing parts.

8. The revolving door according to claim 1, wherein the rotatable door wings or the two door wing parts are slidable.

9. The revolving door according to claim 8, wherein a guide is provided at a position at or near to an end of the vertical bar for guiding the rotatable door wing or the two door wing parts.

10. The revolving door according to claim 1, wherein the two door wing parts are independently slidable.

11. The revolving door according to claim 1, wherein the rotatable door wings or the two door wing parts are collapsible or foldable while remaining connected with or near to the vertical bar of the carrier.

12. The revolving door according to claim 1, wherein the revolving door is convertible between being a revolving door configured with two rotatable door wings extended along the same plane, and a revolving door configured with a third door wing with angles of 120° between the three door wings, while the dimensions of the revolving door are maintained.

13. The revolving door according to claim 1, wherein each of the rotatable door wings comprise a plane along the primary axis of the rotatable door wing, wherein two of the rotatable door wings are extended along the same plane as each other, and wherein the horizontal bars of the carriers of the two rotatable door wings are parallel.

14. The revolving door according to claim 1, wherein the revolving door further comprises a third rotatable door wing, and wherein the horizontal bars of the carriers of the three rotatable door wings are oriented in relation to each other so as to form the shave of a triangle.

15. The revolving door according to of claim 14, wherein the revolving door further comprises a fourth rotatable door wing, and wherein the horizontal bars of the carriers of the rotatable door wings are oriented in relation to each other so as to form the shape of a rectangle.

* * * * *